US005971275A

United States Patent [19]

Leduc et al.

[11] Patent Number: 5,971,275

[45] Date of Patent: Oct. 26, 1999

[54] SYSTEM FOR VERIFYING NUCLEAR WARHEAD PREARM/SAFING SIGNALS

[75] Inventors: Robert G. Leduc, Dighton, Mass.; David D. Schuller, Portsmouth, R.I.; Christopher J. Plezia, Middletown, R.I.; Stanley E. Raymond, Portsmouth, R.I.; Mark A. Werner, San Diego, Calif.

[73] Assignee: The United States of America as represented by the Secretary of the Navy, Washington, D.C.

[21] Appl. No.: 08/775,232

[22] Filed: Dec. 30, 1996

[51] Int. Cl.[6] ..... G06F 19/00; G06G 7/80

[52] U.S. Cl. ..... 235/403; 235/400

[58] Field of Search ..... 114/20.1, 21.1, 114/21.2, 21.3, 23; 89/1.51, 1.55, 1.56, 1.59, 5; 102/275.9, 305, 701; 324/73.1, 74, 158.1; 235/400, 401, 403; 364/578; 348/192, 710

[56] References Cited

U.S. PATENT DOCUMENTS 3,911,478 10/1975 Rhodes ..... 348/192
4,998,963 3/1991 Silvia ..... 102/275.9
5,022,326 6/1991 Silvia ..... 102/275.9
5,614,896 3/1997 Monk et al. ..... 89/1.56 X
5,844,817 12/1998 Lobley et al. ..... 364/578

*Primary Examiner*—Donald Hajec
*Assistant Examiner*—Karl Frech
*Attorney, Agent, or Firm*—Michael J. McGowan; Prithvi C. Lall; Michael F. Oglo

[57] ABSTRACT

A system for collecting, storing, and verifying the data pulse train for prearm and safing of a nuclear warhead on a submarine using MK 63 or 67 torpedo tubes is provided. The components of the system include a notebook computer operating four software programs. The software programs allow collection of the data pulse train, graphing of the collected data, comparing of the collected data with validated samples, and verifying of the validity of the collected data. The notebook computer operates the system through data acquisition expansion boards and a combat control system interface board connected to a Prearm Load Simulator. Data is also recorded on a strip chart recorder which is connected to the system through the Prearm Load Simulator. An adapter cable connects the system to a digital missile simulator and to the submarine's combat control system via the torpedo tube breech door interface.

12 Claims, 2 Drawing Sheets

SYSTEM FOR VERIFYING NUCLEAR WARHEAD PREARM/SAFING SIGNALS

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The invention relates to the field of test instrumentation and in particular to testing of weapons interface systems for Tomahawk nuclear cruise missiles.

(2) Description of the Prior Art

During development of the AN/BSY-1 Submarine Combat System (SCS) and, in particular, during the detailed interface testing which is a part of the final certification testing, the Department of Energy determined that the W80 nuclear warhead-to-submarine combat system interface was invalid. At this late stage of development, the Submarine Combat System could not correctly pre-arm and safe the nuclear weapon. As a result, a costly and time consuming redesign was necessary. In this particular instance, the cost to the U.S. Navy for correction of a problem discovered so late in the development cycle was approximately $1.5 million. This cost would have been greatly reduced if the Navy had a capability to verify weapons interface signal earlier in the development life cycle. Over the lifetime of a project, the costs of correcting problems increases exponentially as development progresses and a larger percentage of components become fixed or relied upon by other parts of the system. A system is needed which provides verification of SCS signals at an early stage of development; especially those signals associated with nuclear warheads where redesign efforts are particularly costly. Additionally, in order to perform tests at early development stages, it is necessary to have a portable or transportable test system which can be moved to various development sites. In order to fully capture the data provided by a modern weapons interface, the system must be fast, reliable and automated. The system must also provide permanent storage of test results for documentation purposes.

SUMMARY OF THE INVENTION

Accordingly, it is an object of the invention to collect samples of pre-arm and safing signals for nuclear warheads.

It is another object of the invention to provide a system for verifying pre-arm and safing signals generated by a Submarine Combat System for nuclear warheads.

It is yet another object of the invention to provide a transportable system which can be setup at different development sites as needed.

It is a further object of the invention to provide a system in which the key components are fully redundant to prevent system downtime due to component failure.

A still further object of the invention is to provide fast, real-time collection and analysis of data as well as permanent storage of test data.

In accordance with these and other objects, a method and apparatus for collecting nuclear warhead verification information comprising a portable notebook computer, an expansion station containing a data interface module and two data acquisition boards, a strip chart recorder, a weapon pre-arm load simulator, and an adapter cable for attachment to a MK75 Digital Missile Simulator and the Submarine Combat System is provided. The system is operated by the notebook computer using four executable programs, SAMPLE.EXE, which operates a data acquisition board located in the expansion station; W80GRAPH.EXE, which allows viewing of individual data points; W80EVAL.EXE, which provides for comparison of the actual nuclear weapon pulse train with verification samples; SAMPLE.EXE, which provides the verification samples; and, READ.EXE, which allows the user to quickly browse through a weapon sample file. The entire system is compact, weighing approximately 250 pounds and is easily transportable from one test site to another. The method of the invention is a computer-driven process in which the Submarine Combat System pulse train is acquired and stored, the pulse train is then graphed, and finally compared against known samples.

BRIEF DESCRIPTION OF THE DRAWINGS

The foregoing objects and other advantages of the present invention will be more fully understood from the following detailed description and reference to the appended drawings wherein.

DESCRIPTION OF THE PREFERRED EMBODIMENTS

Figure 1:
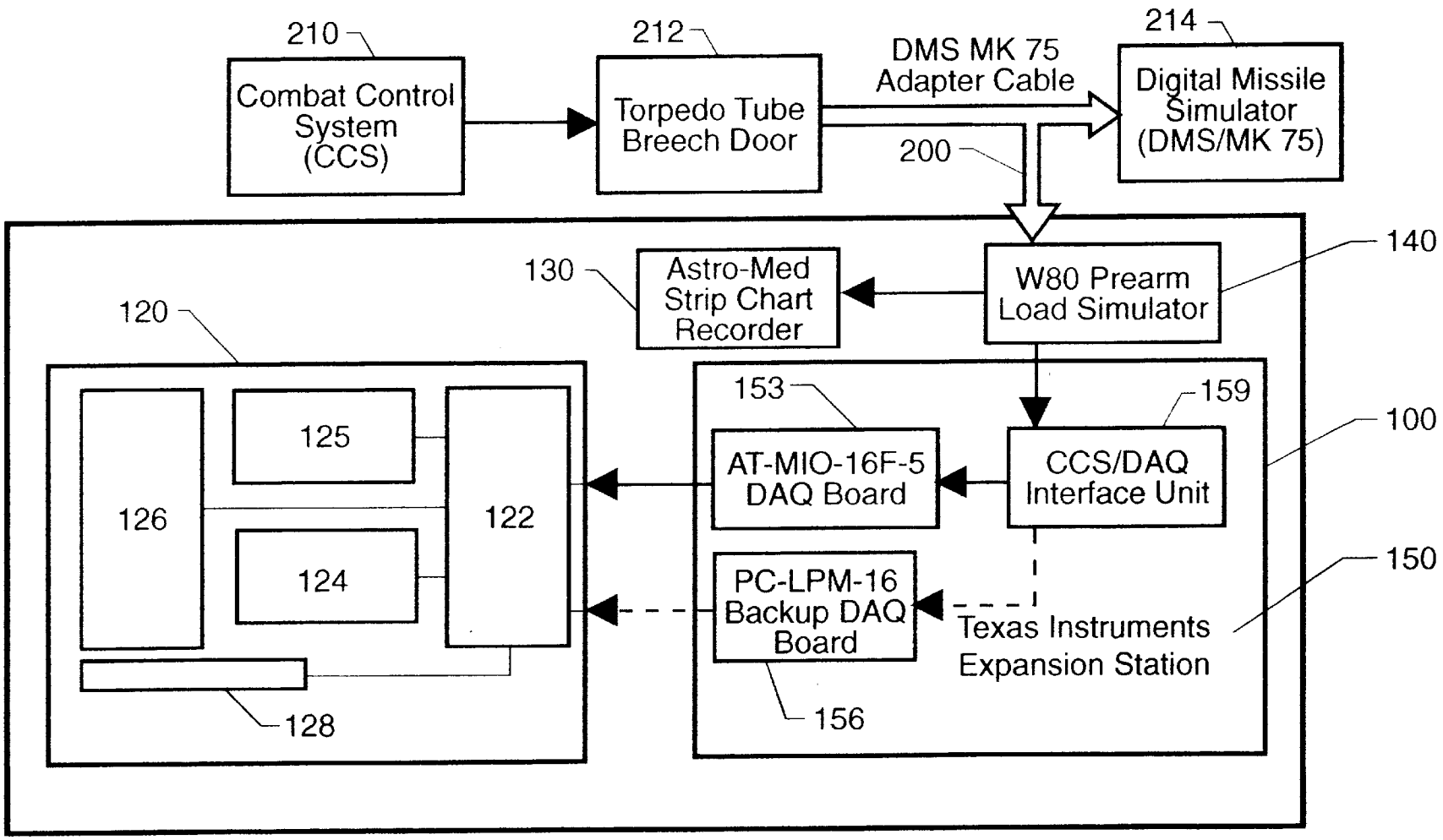
FIG. 1 is a schematic of the components of the nuclear warhead verification system.

Referring now to FIG. 1, the complete weapon safe and arm verification system, designated generally by the reference numeral 100, is shown with its major components. Weapon verification system 100 is connected to submarine combat control system 210 through torpedo tube breech door 212 using MK75 adapter cable 200. MK75 adapter cable 200 has three ends, one of which connects to the submarine combat control system 210 via torpedo tube breech door 212, one of which connects to digital missile simulator 214, and the last of which connects to the weapon Pre-arm Load Simulator 140. When connected in this fashion, signals from combat control system 210 travel through MK75 adapter cable 200 into Pre-arm Load Simulator 140. Pre-arm Load Simulator 140 also monitors signals between digital missile simulator 214 and combat control system 210 which simulate the prearm and safe/reset commands. Pre-arm Load Simulator 140 also connects directly to strip chart recorder 130. Strip chart recorder 130 is a high speed output device which provides an immediate paper copy of the sample data provided by Pre-arm Load Simulator 140.

Pre-arm Load Simulator 140 simultaneously provides data to the remainder of the system through a connection to expansion station 150. Within expansion station 150, submarine systems interface unit 159 provides direct electrical connectivity to Pre-arm Load Simulator 140. Submarine systems interface unit 159 converts these input signals (ranging from 28 to 32 volts DC) into a range that is usable by the low voltage components in the remainder of expansion station 150. This voltage is reduced through the use of a resistor network and op-amp and, on output, is typically in the range between 0 and 10 volts DC. Once the signal is converted by submarine systems interface unit 159, the signal is passed through electrical connections to primary data acquisition board 153 and backup data acquisition board 156. These boards operate simultaneously and convert the incoming analog signal to a digital signal which can be processed by computational engine 120. In the preferred embodiment, both boards are 12 bit, 16 channel analog/digital converters with acquisition speeds of 200,000 samples/second for primary data acquisition board 153 and 50,000 samples/second for backup data acquisition board 156. In the preferred embodiment, the primary board is a National Instruments# AT-MIO-16F-5 Data Acquisition Board and the backup board being a National Instruments™ PC-LPM-16 Data Acquisition Board; however, the use of alternate devices for the conversion of the analog data into digital data is within the scope of the present invention. Data from primary data acquisition board 153 and backup data acquisition board 156 is electronically transmitted to computational engine 120. In the preferred embodiment, computational engine 120 is a notebook computer containing an 80386SX-20 microprocessor, an 80387SX-20 coprocessor, an 85 MB hard drive, a LCD display, and 4 MB of RAM. The data transmission is accomplished through high speed direct memory access transfers; however, alternate computational engines and alternate means of high speed transmissions of the processed digital data between the data acquisition boards and the engine are within the scope of this invention. Within computational engine 120, data is received through acquisition software 122. Acquisition software 122 immediately archives all incoming data to data storage device 128. Acquisition software 122 may also provide data to graphic display software 124 or data evaluation software 125 at the system operator's discretion. Graphic display software 124 provides a graphical display of the data collected from the combat control system. This is similar to an on-screen version of the output provided by strip chart recorder 130. Data evaluation software 125 provides a benchmark of collected data against several user configurable data series. The standard benchmarks contain information detailing the proper signal sequences (reception and transmission order), the allowable time delays between the transmission and/or receipt of successive signals, signal voltage levels, and the like. In the present invention, these benchmarks include the three ICD test standards for warhead and umbilical tests. Both graphic display software 124 and data evaluation software 125 can be started using either data collected by acquisition software 122 or data archived on data storage device 128; however, the processing requirements for high speed data collection when acquisition software 122 is in use may limit the usability of these packages on low bandwidth computational engines. Finally, raw data display software 126 can be used to read and display the numeric test data for any test or standard benchmark stored on data storage device 128.

Figure 2:
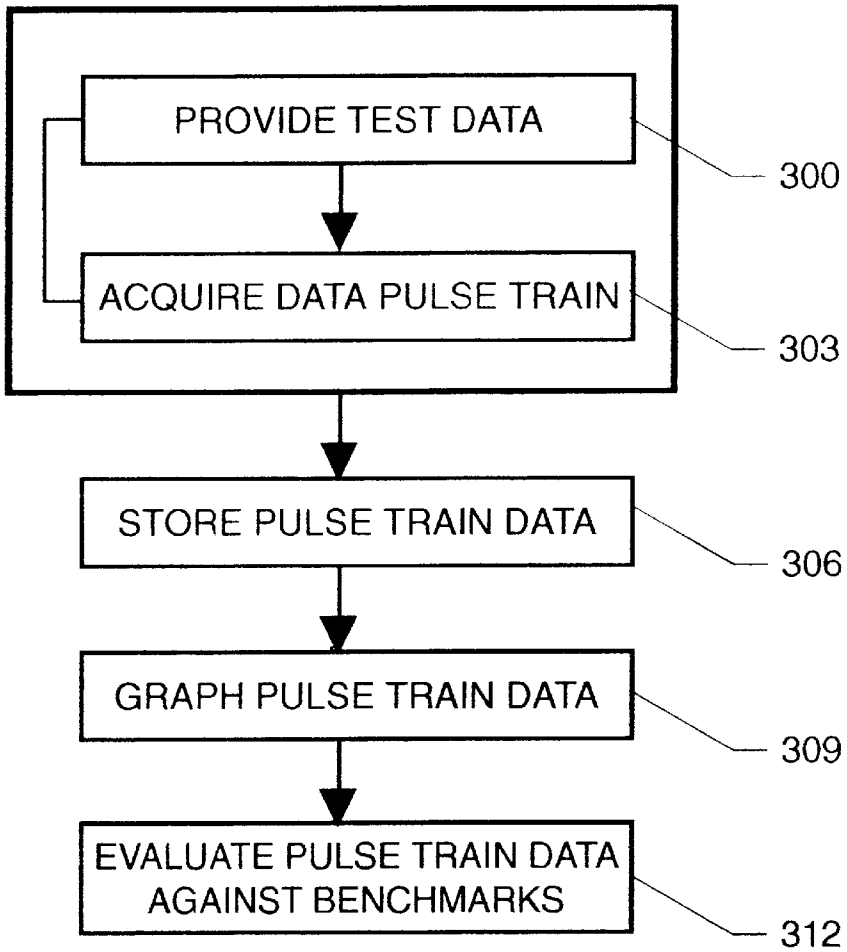
FIG. 2 is a flowchart of the process of verifying nuclear warhead test data.

Referring now to FIG. 2, a flowchart for the method of the invention is shown. In order to verify the operation of the submarine combat control system, the present invention uses the steps as shown. First, in step 300, test inputs are provided to the combat control system. These test inputs simulate the desired test scenarios, specifically warhead pre-arm and safe/reset commands. As step 300 is underway, step 303 is also underway. The pulse train data from the submarine combat control system is acquired. Once all of the data has been acquired, the pulse train is permanently stored in step 306. The stored data from step 306 is used to graph the pulse train data in step 309, allowing a visual inspection of the test results. Finally, the data is also compared against benchmark data in step 312. The system, in the preferred embodiment, automates the steps of this method; however, the method can be used in a manual fashion for analysis of combat control systems in cases where the system is not available.

The new features and advantages of the present invention are numerous. The system provides the Navy with the capability to validate SCS-to-W80 nuclear warhead interfaces during various phases of the development life cycle, particularly at an earlier point then was previously possible. Further, the entire system, based on a notebook personal computer and weighing only 250 pounds with all necessary components, is easily transportable. This transportability allows testing to be accomplished at development sites having different locations. Additionally, the system uses standard parts for most of the processing requirements; however, for the data acquisition board, the system has built-in redundancy in case the first board should fail. Both boards maintain high acquisition data rates, allowing the complete system to easily sample at very short intervals. This is particularly important for testing of delays in combat control system response. The system also provides permanent storage of all test results, through both a printed hard-copy format and electronically on the disk of the computer system.

Although the invention has been described relative to a specific embodiment thereof, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A weapon safe and arm verification system for nuclear warheads comprising:

an adapter cable having first, second and third connectors and being connected with said first connector to a digital missile simulator and with said second connector to a submarine combat control system through a torpedo tube breech door;

a prearm load simulator connected to the third connector of said adapter cable and having first and second output data connectors;

a strip chart recorder connected to the first output data connector of said prearm load simulator;

an expansion station having dual digital output connectors and being connected to the second output data connector of said prearm load simulator; and a computational engine connected to said dual digital output connectors of said expansion station, said computational engine having acquisition software, graphic display software, data evaluation software and benchmark data.

2. A weapon safe and arm verification system for nuclear warheads as in claim 1 wherein said computational engine is a notebook personal computer.

3. A weapon safe and arm verification system for nuclear warheads as in claim 1 wherein said expansion station further comprises:

a submarine system interface unit having an analog input line connected to said adapter cable, a voltage reducing resistor network and op-amp, and low voltage output line; and a data acquisition unit having an analog input line connected to the low voltage output line of said submarine system interface unit.

4. A weapon safe and arm verification system for nuclear warheads as in claim 3 wherein said data acquisition unit further comprises a plurality of data acquisition boards each connected in parallel with said submarine system interface and operating concurrently.

5. A weapon safe and arm verification system for nuclear warheads as in claim 1 wherein said computational engine further comprises a data storage device.

6. A weapon safe and arm verification system for nuclear warheads as in claim 5 wherein said graphic display software and said data evaluation software can use data provided by either said acquisition software or said data storage device.

7. A weapon safe and arm verification system for nuclear warheads as in claim 1 wherein said graphic display software and said data evaluation software operate concurrently with said acquisition software, providing real-time data analysis against said benchmark data.

8. A weapon safe and arm verification system for W80 nuclear warheads comprising:

means for simulating W80 pre-arm and safing load signals;

a strip chart recorder connected to said means for simulating;

means for data acquisition of W80 pre-arm and safing signals connected to said means for simulating;

a notebook computer connected to said means for data acquisition; and executory software for sampling, comparing and graphing of the pre-arm and safing load signals.

9. A weapon safe and arm verification system as in claim 8 wherein said means for simulating comprises a W80 pre-arm load simulator.

10. A weapon safe and arm verification system as in claim 9 wherein said means for simulating further comprises an adapter cable for attaching said W80 pre-arm load simulator to a torpedo tube breech door interface and to a MK75 digital missile simulator.

11. A weapon safe and arm verification system as in claim 8 wherein said means for data acquisition comprises a notebook computer expansion station.

12. A weapon safe and arm verification system as in claim 11 wherein said notebook computer expansion station comprises a combat control system/data acquisition interface unit connected in parallel, to a National Instrument™ AT-MIO-16F-5, data acquisition board and a National Instrument™ PC-LFM-16 data acquisition board.

* * * * *